United States Patent [19]

Rumfola

[11] 4,302,113

[45] Nov. 24, 1981

[54] METHOD AND APPARATUS FOR ADMIXING PHOTOGRAPHIC PROCESSING COMPOSITIONS

[75] Inventor: Ross E. Rumfola, Avon, N.Y.

[73] Assignee: Eastman Kodak Company, Rochester, N.Y.

[21] Appl. No.: 139,519

[22] Filed: Apr. 11, 1980

[51] Int. Cl.[3] ..... B01F 15/02

[52] U.S. Cl. ..... 366/150; 137/896; 366/336

[58] Field of Search ..... 366/150, 336, 337, 339, 366/341, 165, 167, 177, 182; 137/604

[56] References Cited

U.S. PATENT DOCUMENTS

| | | | |
|---|---|---|---|
| 3,147,955 | 9/1964 | Harvey | 366/150 |
| 3,334,657 | 8/1967 | Smith | 137/604 |
| 3,728,129 | 4/1973 | Sargeant | 99/78 |
| 3,868,967 | 3/1975 | Harding | 366/177 |
| 3,892,389 | 7/1973 | Contastin . | |
| 4,093,188 | 6/1978 | Horner | 366/336 |

*Primary Examiner*—Edward J. McCarthy
*Attorney, Agent, or Firm*—M. S. Sales

[57] ABSTRACT

A method and apparatus for admixing liquid with concentrated, shear-thinable stiff pastes of photographic processing compositions to form photographic processing solutions, in which the pastes are thinned by shear forces and contacted with the diluting liquid under turbulent mixing conditions to dissolve the concentrate in the liquid and thereby form the solution. The paste, which does not flow and resists deformation under conditions of low shear, is displaced through an orifice where conditions of high shear render it free flowing and form a stream. One or more liquid jets are directed at the stream with sufficient force to disperse the concentrate and bring about intimate contact between the liquid and the composition under turbulent mixing conditions. A static mixer then completes the dissolution of the chemicals in the liquid.

10 Claims, 2 Drawing Figures

METHOD AND APPARATUS FOR ADMIXING PHOTOGRAPHIC PROCESSING COMPOSITIONS

BACKGROUND OF THE INVENTION

1. Field of the Invention

The present invention relates to a method and apparatus for admixing concentrated photographic compositions with liquids to form processing solutions, and more specifically for admixing shear-thinable, processing compositions having the consistency of a stiff paste. As used herein the term "photographic processing solution" is intended to include developing solutions, replenisher solutions, starter solutions, and other working photographic solutions.

2. Brief Description of the Prior Art

It is well known to supply photographic processing compositions in concentrated form, including liquids, powders, tablets and even pastes and gels, which are diluted with water to form photographic processing solutions.

Due perhaps to the simplicity of the dispensing and mixing equipment, liquid concentrates are generally preferred over the other forms of concentrates by most professional photofinishers. In one approach, for example, the liquids are supplied in plastic bottles that are closed by a rupturable membrane and a protective cap. After removing the cap, each bottle is positioned upside-down over a receiving tank where a sharp probe pierces the membrane and releases the liquid. Water is added to dilute the mixture to the proper concentration for a photographic processing solution.

Although liquid concentrates have been widely accepted, powders have certain advantages, particularly in connection with storage and shipping. Amateur photographers, for example, often prefer the powders for their compact form and long shelf life. In general, however, many of the powdered concentrates are considered difficult to dissolve and dilute. While satisfactory equipment is certainly available for this purpose, it tends to be either bulky or suitable only for small batches, and is not particularly convenient for use by unskilled operators or with high volume automated processing equipment.

Of course some of the problems associated with powders can be alleviated by compressing them into tablets. Generally speaking, however, the tablets are not a viable commercial alternative. In particular, the tablets cannot incorporate liquids, and many photographic processing compositions are not amenable to tablet formation. Those that are, usually incorporate binding agents which can make dissolution of the tablet quite difficult and/or cause undesirable sensitometric effects in processing. Although effervescing agents have been employed to promote prompt dissolution, they are generally not very effective and introduce additional costs and complexity in the manufacturing operation.

At least several attempts have been made to obtain the advantages simultaneously of the powders and the liquids by constructing pastes and gels which contain relatively little water but are easier to dissolve than their corresponding powders. Examples of this approach are described in U.S. Pat. No. 2,735,774, entitled CONCENTRATED PHOTOGRAPHIC FIXING SOLUTIONS, issued in the name of R. W. Henn in 1956; British Patent No. 4689 AD 1894, entitled IMPROVEMENTS IN THE PREPARATION, PACKING AND STORING OF PHOTOGRAPHIC CHEMICAL COMPOUNDS issued in the name of the J. R. Gale et al in 1895; and Italian Patent No. 427,967, entitled METHOD FOR THE PREPARATION OF A DEVELOPER CONDENSED INTO PASTE, FOR PLATES, PHOTOSENSITIVE PAPER FILMS, issued in the name of V. Barra.

Although pastes and gels have been known for some time, their advantages have not been fully realized, nor has the prior art recognized how to use the pastes to obtain the full benefit of these advantages. By way of example only, it appears that pastes have been dispensed manually from their supply containers and mixed by manual stirring and similar techniques. For this and other reasons most pastes were relatively soft, and contained an undesirable amount of water. Pastes having reduced amounts of water were considered difficult to dissolve and possessed some of the disadvantages of tablets. It will become apparent from the following description that the present invention overcomes many of these disadvantages of the prior art and provides significant additional features not previously available.

SUMMARY OF THE INVENTION

In accordance with the present invention, apparatus and methods are provided for admixing concentrated photographic processing compositions with diluting fluids to form photographic processing solutions. The compositions are stiff pastes that behave in many respects like a solid, but are shear-thinable so that when shear thinned and then contacted with a diluting liquid under turbulent mixing conditions they will disperse and dissolve to form solutions.

In accordance with a preferred embodiment of the invention, the concentrate is discharged through an orifice to form a flowing stream thinned by shear forces in the orifice. The stream passes through a primary mixing chamber where a liquid is introduced in one or more jets that impinge on the stream with sufficient force to disperse the concentrate and bring about intimate contact between the concentrate and the liquid under turbulent mixing conditions. A mixer having internal stationary baffles may be employed to effect secondary mixing and complete the dissolution of the concentrate in the liquid.

The invention and its advantages will become more apparent from the detailed description which follows.

BRIEF DESCRIPTION OF THE DRAWINGS

In the detailed description of the preferred and alternative embodiments presented below, reference is made to the accompanying drawings, in which.

DETAILED DESCRIPTION OF THE PREFERRED EMBODIMENT

Figure 1:
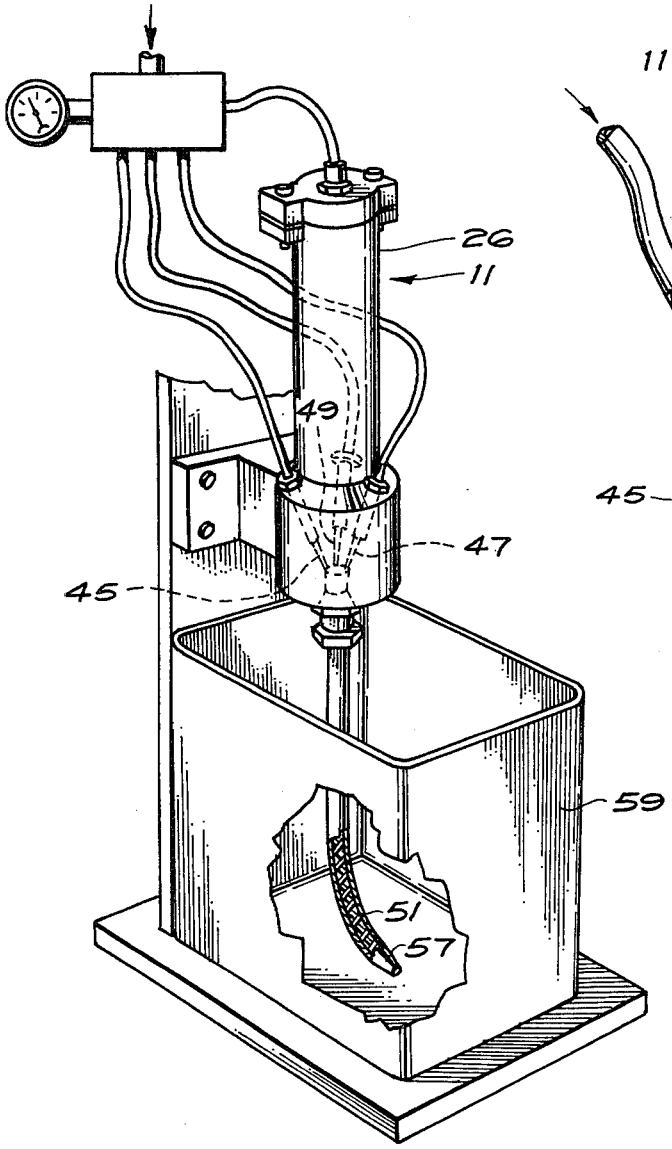
FIG. 1 is a perspective view of apparatus in accordance with a preferred embodiment of the present invention for admixing a shear-thinable photographic processing composition with a liquid to form a processing solution.
Figure 2:
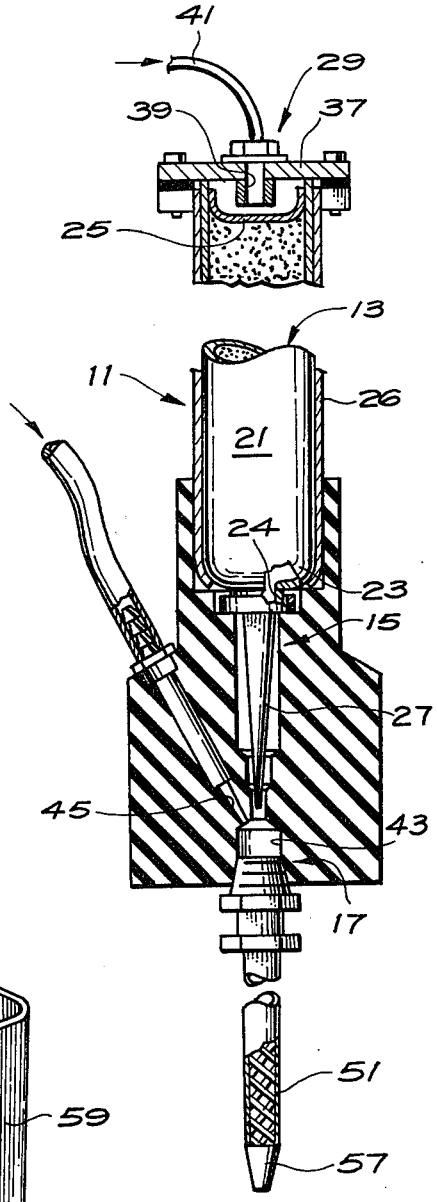
FIG. 2 is a cross-sectional view of a portion of the apparatus illustrated in FIG. 1, depicting a mechanism for displacing the processing composition through an orifice to thin the composition with shear forces and for contacting the thinned composition with a liquid to bring about intimate contact between the composition and the liquid to dissolve the composition in the liquid.

Referring now to the drawings, a preferred embodiment of apparatus in accordance with the present invention is depicted in FIGS. 1 and 2. The apparatus comprises a receptacle 11 for receiving a package 13 of concentrated, shear-thinable, photographic processing composition, a mechanism 15 for shear thinning the composition and a mixing chamber 17 for contacting the thinned composition with a liquid to disperse and dissolve the composition in the liquid and thereby to form a photographic processing solution.

The composition and package are more fully described in commonly assigned, copending U.S. Patent Application Ser. No. 139,518, entitled PHOTOGRAPHIC PROCESSING CONCENTRATES, filed in the name of Richard W. Dillon et al; and Ser. No. 139,517, entitled PACKAGE OF PHOTOGRAPHIC PROCESSING COMPOSITION, filed in the name of Ross Rumfola, both on even date herewith, which for convenience are hereby incorporated by reference into the present application. Briefly, however, the processing composition includes chemical ingredients used in processing photographic film, paper or plates when diluted with a liquid, such as water, to form a photographic processing solution. The ingredients are present in continuous phases and discontinuous phases that form a concentrated, semi-solid having the consistency of a stiff paste that resists physical deformation. In this viscous state, the composition is not readily dissolvable in water. Of particular importance to the present invention, the composition is shear-thinable, by which is meant its viscosity is substantially reduced when subjected to shearing such as encountered when the composition is displaced through a constricting orifice. Under such conditions of high shear, the composition becomes free flowing much like a liquid and, in the manner described hereinafter, can be dispersed and dissolved in a dilutant such as water.

Although the composition could be supplied in various packages, in a preferred embodiment the package is a dispensing tube 21 having a necked-down portion 23 including an opening 24 at one end of the tube, and a pressure transferring device 25, such as a movable cup, which fits inside the tube at the other end. Prior to use, the neck opening is closed by a rupturable membrane and a protective cap, not shown, so the package is impervious to the inward diffusion of atmospheric gases and the outward diffusion of the composition. Thus, the tube protects the composition from deterioration and, as will become apparent from the following description, serves during use to dispense the composition to the apparatus. When the cap is removed and the membrane ruptured, the composition can be forced from the tube through the opening 24 by applying pressure, such as would be available in a common water line, against cup 25.

The receptacle 11 includes a cylindrical sleeve 26 which conforms generally to the configuration of the tube and provides support so the tube can be of relatively thin wall construction yet will not distort under pressure when the composition is discharged from the tube.

The shear thinning mechanism 15 includes an orifice comprising a cone-shaped nozzle 27, coupled to the neck of the dispensing tube. In this preferred embodiment, the nozzle is intended to replace the protective end cap on the tube. It should be understood, however, that the nozzle could be a part of the mixing apparatus into which the necked-down portion of the tube is inserted, rather than a part of the tube itself. Similarly, the orifice could have configurations other than a nozzle, such as a circular opening having little or no longitudinal dimension. The nozzle configuration has the advantage of increasing the distance over which the processing composition is subjected to shearing, and, when the nozzle decreases in cross-section from the base to the tip as shown the shearing is increased as the composition is thinned. Additionally, the tip of the nozzle can be clipped at a location selected to provide the desired final cross-sectional area. Thus, a single nozzle design can be used for different processing compositions having different shear-thinning characteristics. Whatever type of orifice is used, it should thin the composition substantially. In this embodiment, for example, the processing composition leaves the aperture as a flowing stream.

Water pressure is applied to the cup to force the composition out of the opening in the neck of the tube and through the nozzle. End cap 37 is clamped to the end of the cylindrical sleeve, and engages the end of the tube in a liquid tight seal so that water pressure can be applied to the cup through tap hole 39 and pressure line 41.

The mixing chamber actually includes two parts. The first part, a primary mixing chamber 43, has a primary inlet through which the processing composition enters and at least one and preferably three secondary inlets 45, 47, 49 for directing a diluting liquid into contact with the composition. In FIGS. 1 and 2 the liquid is directed from three jets against the center of the shear-thinned processing composition, which is dispensed from the end of the nozzle as a flowing stream. The liquid jets impinge on the stream with sufficient force to effect dispersion thereof and to bring about intimate contact between the composition and the liquid under turbulent mixing conditions. The jets enter the mixing chamber at an angle of approximately thirty (30) degrees to the stream of the processing composition and are aimed toward its center. Of course other arrangements would also be suitable. The jets could be oriented ninety (90) degrees tangential to the stream, for example.

The second part of the mixing chamber comprises a static mixer 51 which communicates with the output of the primary mixing chamber and effects secondary mixing to thereby complete the dissolution of the composition in the liquid. Mixer 51 has internal stationary baffles, and may take the form of that shown in U.S. Pat. No. 4,093,188 entitled STATIC MIXER AND METHOD OF MIXING FLUIDS, issued June 6, 1978.

From the mixing chamber, the diluted composition referred to as the processing solution, is directed through a hose 57 and into a collecting tank 59 where it is ready for use.

The method of the present invention in its preferred embodiment thus includes the steps of shearing a shear-thinable photographic processing composition to thin the composition and then contacting the thinned composition with a liquid under turbulent mixing conditions to form a photographic processing solution. Shearing is accomplished, for example, by displacing the composition through an orifice to form a flowing stream which is dispersed by one or more liquid jets. The dispersed stream is then repeatedly divided in a static mixer to further dissolve the composition in the liquid.

In its simplest form a premeasured quantity of the concentrate is contained in the package. The entire contents of the package are then dispensed to the diluting apparatus, which adds a predetermined quantity of the diluting liquid. The addition of the liquid begins approximately simultaneously with the dispensing of the concentrate, but continues for some period after the package is emptied, to ensure that all of the concentrate is moved through the mixing chambers to the solution-collecting tank.

It should now be apparent that the method and apparatus of the present invention provide important advantages for photographic processing that are not available from the teaching of the prior art. The processing composition can be supplied and used in a manner that possesses the advantages of both powders and liquids. Prior to thinning, the composition is almost like a solid that resists gravitational displacement or spilling and has excellent shipping and storage characteristics. After thinning, the composition is free flowing, moves easily through tubes and conduits and dissolves readily in liquids such as water when subjected to turbulent mixing conditions.

I claim:

1. A method of preparing a solution from a shear-thinable concentrate paste of a photographic processing composition; said method comprising the steps of:

shear thinning the processing composition to thin the composition; and contacting said thinned composition with a liquid under turbulent mixing conditions to disperse and dissolve said composition in said liquid and thereby form said solution.

2. A method of preparing a photographic processing solution from a shear-thinable paste concentrate, comprising the steps of:

displacing the concentrate through a constricting orifice to shear thin the concentrate; and contacting said shear-thinned concentrate with a liquid under turbulent conditions to dissolve said concentrate in said liquid and thereby form said solution.

3. A method of preparing a photographic processing solution from a shear-thinable paste concentrate, said method comprising the steps of:

displacing the concentrate through an orifice to shear thin the concentrate and form a flowing stream of the concentrate;

impinging said flowing stream of shear-thinned concentrate with a jet of liquid with sufficient force to disperse said concentrate; and mixing the concentrate with the liquid to dissolve the concentrate in the liquid and form the solution.

4. The method set forth in claim 3 wherein said concentrate is supplied in a container which is emptied while said jet of liquid is impinged upon the flowing stream.

5. The method set forth in claim 4 wherein said jet of liquid is continued for a predetermined time after the container is emptied.

6. The method set forth in claim 3, wherein said concentrate is supplied in a premeasured quantity and a predetermined quantity of the liquid is added thereto.

7. A method of dispensing liquid-soluble, shear-thinable, semi-solid concentrate from a container and admixing the dispensate with a liquid to form a photographic processing solution, said method comprising the steps of:

displacing said concentrate from said container through an orifice to shear thin the concentrate;

directing said thinned concentrate into a mixing zone;

introducing into said mixing zone at least one jet of said liquid in a direction to impinge on said thinned concentrate with sufficient force to effect dispersion thereof and bring about intimate contact between said concentrate and said liquid within said mixing zone under turbulent mixing conditions, thereby effecting primary mixing of said concentrate with said liquid; and directing the effluent from said mixing zone through a baffled mixer for effecting secondary mixing of said effluent to thereby complete the dissolution of said concentrate in said liquid.

8. Apparatus for admixing a shear-thinning, semi-solid photographic processing composition with a liquid to form a processing solution, said apparatus comprising:

means forming a constricted orifice;

means for moving the composition through said constricted pressure to shear thin the composition; and means for contacting the thinned composition with the liquid under turbulent mixing conditions to disperse and dissolve the composition in the liquid and form said solution.

9. Apparatus for admixing a shear-thinable, semi-solid photographic processing composition with a liquid to form a processing solution, said apparatus comprising:

means forming a mixing chamber;

means for shearing the composition to thin the composition;

means for simultaneously introducing the shear-thinned composition and the liquid into said chamber to bring about contact between the composition and the liquid; and means for turbulently mixing the composition and the liquid to disperse and dissolve the composition in the liquid.

10. Apparatus for admixing a shear-thinable, semi-solid photographic processing composition with a liquid to form a processing solution, said apparatus comprising:

means forming a constricted orifice, means for displacing the composition through said orifice to shear thin the composition;

means forming a mixing chamber for effecting primary mixing of the composition with the liquid, said mixing chamber having a primary inlet adapted to receive said thinned composition, at least one secondary inlet, and an outlet;

means for introducing the liquid into said mixing chamber through said secondary inlet in the form of a jet impinging on said shear-thinned composition with sufficient force to effect dispersion thereof to bring about intimate contact between the composition and the liquid within said mixing chamber under turbulent mixing conditions; and a baffled mixer communicating with the outlet from said mixing chamber for effecting secondary mixing of the effluent from said mixing chamber to thereby complete the dissolution of the composition in the liquid.

* * * * *

UNITED STATES PATENT AND TRADEMARK OFFICE

CERTIFICATE OF CORRECTION

PATENT NO. : 4,302,113

DATED : November 24, 1981

INVENTOR(S) : Ross E. Rumfola

It is certified that error appears in the above—identified patent and that said Letters Patent is hereby corrected as shown below:

Column 4, line 48, delete "static".

Column 6, line 25, after "stricted" insert --orifice under--.

Signed and Sealed this

*Eighth* Day of *June 1982*

[SEAL]

*Attest:*

GERALD J. MOSSINGHOFF

*Attesting Officer*

*Commissioner of Patents and Trademarks*